United States Patent [19]

Broker

[11] Patent Number: 4,703,871

[45] Date of Patent: Nov. 3, 1987

[54] PORTABLE TWO-LIQUID DISPENSER

[76] Inventor: James D. Broker, 103 College, SE., Apt. No. 4, Grand Rapids, Mich. 49503

[21] Appl. No.: 825,207

[22] Filed: Feb. 3, 1986

[51] Int. Cl.[4] ..... A47G 19/12

[52] U.S. Cl. ..... 222/144.5; 222/473; 222/485; 222/545; 222/556; 222/465.1

[58] Field of Search ..... 222/142.6, 144.5, 129, 222/465 A, 470, 472, 473, 476, 471, 485, 545, 502, 556

[56] References Cited

U.S. PATENT DOCUMENTS

| | | | |
|---|---|---|---|
| 795,408 | 7/1905 | Nebinger . | |
| 956,942 | 5/1910 | Clemmer . | |
| 982,371 | 1/1911 | Lacy . | |
| 1,235,985 | 8/1917 | Leckey | 222/144.5 |
| 1,312,203 | 8/1919 | Picard . | |
| 1,419,515 | 6/1922 | Peduto et al. . | |
| 1,472,007 | 10/1923 | Jones . | |
| 2,312,584 | 3/1943 | Peterson . | |
| 2,604,233 | 7/1952 | Murphrey . | |
| 2,681,745 | 6/1954 | Sung et al. . | |
| 3,847,311 | 11/1974 | Flores et al. | 222/473 |
| 4,651,900 | 3/1987 | Horvath | 222/144.5 |

FOREIGN PATENT DOCUMENTS

| | | | |
|---|---|---|---|
| 179021 | 11/1935 | Switzerland . | |
| 19809 | of 1907 | United Kingdom . | |
| 1529141 | 10/1978 | United Kingdom | 222/465 A |

OTHER PUBLICATIONS

Union Carbide publication "Designing for Performance . for Value, Nov. 9, 1980.

*Primary Examiner*—Joseph J. Rolla
*Assistant Examiner*—Frederick R. Handren
*Attorney, Agent, or Firm*—Varnum, Riddering, Schmidt & Howlett

[57] ABSTRACT

A portable liquid dispenser for dispensing one of two liquids from a single vessel has a base with first and second separate horizontally disposed compartments separated by a liquid-impermeable barrier, a neck secured to the base and mounting handle, a valve assembly including first and second valve elements rotatably mounted in the neck for swinging between open and blocking relationship with the compartments and a valve seat in snap-fit relationship with the valve assembly. The valve elements swing downwardly for alternate abutment with the impermeable barrier and into sealing engagement with the valve seat. An actuator is coupled to the valve elements through a shaft and is positioned for actuation by the thumb of a user which grips the handle. The base can be formed in separate injection-molded sections which are secured together and which have a stainless steel bottom integrally molded into the bottom of the section.

24 Claims, 4 Drawing Figures

PORTABLE TWO-LIQUID DISPENSER

FIELD OF THE INVENTION

This invention relates to portable liquid dispensers. In one of its aspects, the invention relates to a liquid dispenser for selectively dispensing one of two liquids from a single vessel.

BACKGROUND OF THE INVENTION

In restaurants today, it is common to offer regular coffee and caffeine-free coffee (Sanka). The waiter or waitress typically walks around to the tables and offers patrons coffee from one of two pots - one for regular and one for caffeine-free. This procedure requires that the waiter or waitress use both hands to carry the pots. This procedure is quite cumbersome and can even be dangerous.

Typically the pots are of a spherical shape and are made of glass. It is reported that these glass pots have an average service life of about two months.

Heretofore, vessels have been designed to selectively dispense one of two liquids carried by the vessels. See for example:

Swiss patent No. 179,021, issued Nov. 1, 1935;
U.S. Pat. No. 795,408, issued July 25, 1905;
U.S. Pat. No. 1,312,203, issued Aug. 5, 1919;
U.S. Pat. No. 1,419,515, issued June 13, 1922;
U.S. Pat. No. 1,472,007, issued Oct. 23, 1923;
U.S. Pat. No. 2,604,233, issued July 22, 1952.
U.S. Pat. No. 2,681,745, issued June 26, 1954;

British specification No. 19,809, published Aug. 27, 1908, discloses a multiliquid vessel for coffee and milk, which can be dispensed simultaneously. The dispenser actuator is mounted near the handle so that the person holding the pot by the handle can use his or her thumb to actuate the dispensing of coffee and milk simultaneously as the dispenser is tipped for pouring.

Condiment holders for granulated solids, such as salt and pepper, have also been devised for selectively dispensing one of the solids. See, for example, the U.S. Pat. Nos. to Clemmer 956,942, issued May 3, 1910, and Lacy 982,371, issued Jan. 24, 1911.

All of the foregoing dispensers are not readily adaptable to the modern spherical coffeepots which are used in today's restaurants. Further, the dispensers all appear relatively complex and expensive to manufacture.

It is also known to make spherical coffeepots with a stainless steel bottom portion and a polysulfone injection-molded plastic top portion. See, for example, Union Carbide publication entitled "Designing for Performance, Not For Value" dated Nov. 9, 1980.

SUMMARY OF THE INVENTION

According to the invention, there is provided a hand-held liquid dispenser for selectively dispensing one of two different liquids from a single container which is easily operated by a user with one hand. The dispenser can be molded integrally from plastic and in the shape of conventional coffeepots used today. The pots can be top-loaded and top dispensed as is the convention in modern spherical-shaped coffeepots.

The liquid dispenser comprises a base forming first and second separate horizontally disposed compartments separated by a liquid impermeable barrier. A neck is secured to the base and mounts a handle at one side and forms a spout at an opposite side. The neck has a central opening through which liquid may be introduced into the base and dispensed therefrom. A valve means is mounted in the neck and has first and second valve elements rotatably mounted for rotation in unison in the neck between first and second positions. The first valve element is adapted to block communication between the first compartment and the spout when in the first position and is adapted to open communication between the first compartment and the spout in the second position. In like manner, the second valve element is adapted to open communication between the second compartment and the spout when in a first position and to block communication between a second compartment and the spout when in a second position. An actuator means is coupled to the valve means for moving the valve elements between first and second positions and is mounted on the neck in close proximity to the handle so that the actuator means can be operated by the thumb of a user whose hand grips the dispenser by the handle.

The valve means preferably comprises a sleeve forming semi-circular valve seats at a bottom portion thereof. The impermeable barrier comprises a wall which extends up to the valve seats. The valve elements are preferably semicircular in shape and rotatable from a position adjacent the wall portion to a position in sealing contact with the valve seats. In a preferred embodiment of the invention, the valve elements have an included angle of about 60° therebetween.

The sleeve is constructed so that valve elements are rotatably mounted therein. Further, the sleeve is mounted in snap-fit engagement in the neck. The sleeve is preferably molded of a relatively soft material to form pliant seats. In addition, the valve elements and actuator are mounted in snap-fit engagement in the sleeve. Thus, the sleeve, valve elements and actuator are easily mounted together and can be separated as necessary for cleaning.

In a preferred embodiment of the invention, the base is at least partially molded from a plastic material with the liquid-impermeable barrier. Further, a metal bottom plate is integrally molded to the molded plastic base material to provide a temperature—conducting and temperature-resistant surface.

BRIEF DESCRIPTION OF THE DRAWINGS

The invention will now be described with reference to the accompanying drawings in which.

DETAILED DESCRIPTION OF THE DRAWINGS

Figure 1:
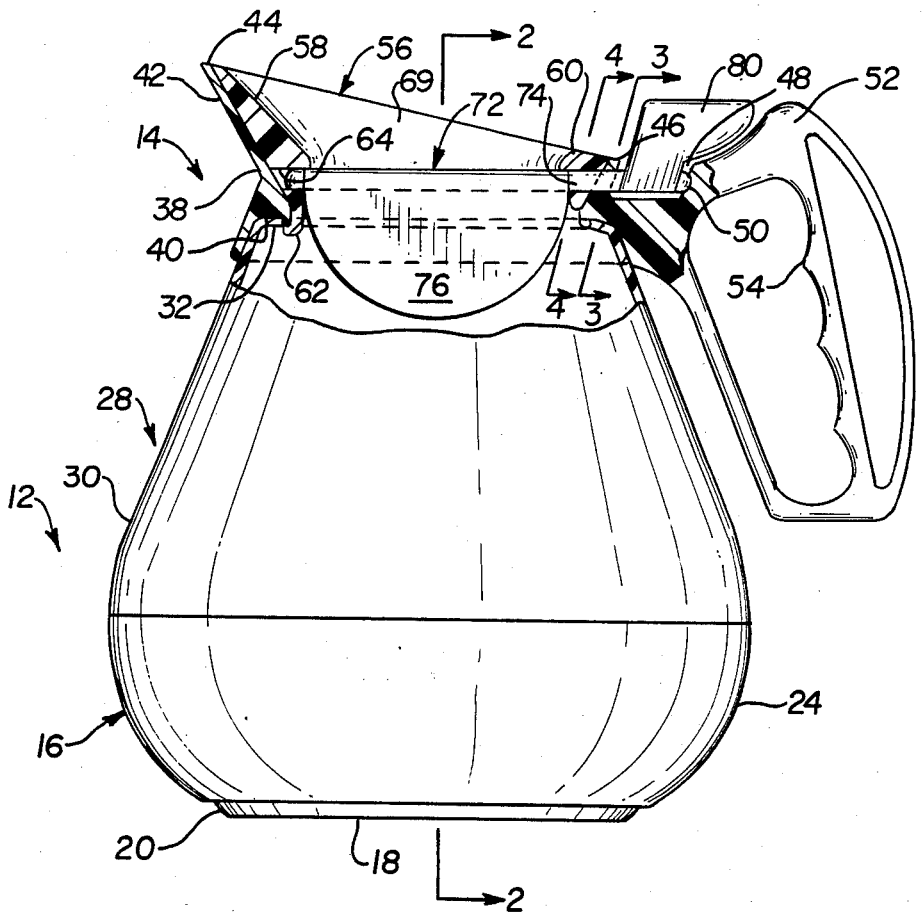
FIG. 1 is a side elevational view, partly broken away, showing a dual coffee server according to the invention.
Figure 2:
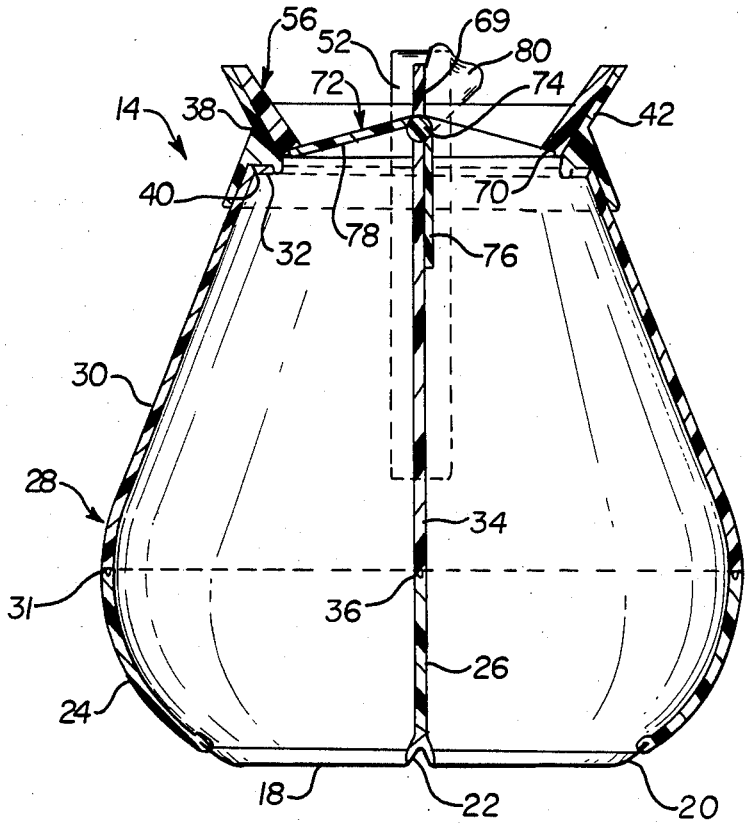
FIG. 2 is a sectional view taken along lines 2—2 of FIG. 1.

Referring now to the drawings and to FIGS. 1 and 2 in particular, there is shown a dual coffee server having a base portion 12 and a neck portion 14. The base portion 12 is formed by a lower section 16 and an upper section 28 which are joined together at facing edges. The lower section 16 has a stainless steel plate 18 forming the very bottom portion thereof. The plate 18 has an upturned rim 20 and a central ridge 22 extending diametrically across the plate. The lower section 16 further includes a molded-plastic base rim 24 which extends upwardly and outwardly from the upturned rim 20 of the stainless steel plate 18. A divider 26 extends diametrically across the base rim 24 and is joined to the upstanding rim 20. As seen in FIG. 2, the end of the upturned rim 20 is received within the lower edge of the base rim 24. Preferably, the base rim 24 is molded from a suitable plastic material, such as a polysulfone (manufactured by Union Carbide under the mark UDEL). Preferably, the stainless steel plate 18 is molded into the base rim 24 during the molding operation whereby the stainless steel plate 18 is integrally joined with the plastic base rim 24 and with the divider 26, forming sealed joints therebetween.

The upper section 28 formed from a molded outer wall 30 having a bottom edge 31, an inwardly directed upper lip 32 and a central divider 34. The bottom edge 31 is joined to the upper edge of the molded plastic base rim 24, for example, by solvent welding or a suitable adhesive. The central divider 34 extends diametrically across the molded outer wall 30 and is integrally molded therewith. The central divider 34 extends above the upper lip 32 at the upper portion thereof and extends down to and meets the divider 26 in the lower section 16. A lower edge 36 of the central divider 34 is secured to the upper edge of the divider 26, by solvent welding or suitable adhesives to form a sealed joint therebetween.

The upper section 28 is preferably formed by injection molding from a suitable plastic material such as polysulfone, for example, manufactured by Union Carbide under the UDEL trademark. The plastic base rim 24 can be molded of an opaque or clear polysulfone whereas the upper section 28 is preferably molded from a clear polysulfone.

Figure 3:
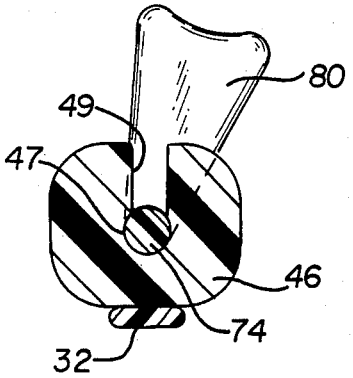
FIG. 3 is a partial sectional view taken along lines 3—3 of FIG. 1.

The neck portion 14 comprises a handle molding 38, an annular sleeve 56 and a flapper valve assembly 72. The handle molding 38 is an annular molded piece having a lower annular channel 40 which snugly fits the upper lip 32 of the molded outer wall 30. Handle molding 38 is secured to the molded outer wall 30 at the lower annular channel 40 through a suitable adhesive or solvent welding. The handle molding 38 has a sloping upper rim portion 42 forming a spout portion 44 at a front side and sloping downwardly to a rear portion 46. A circular bore 47 is formed in the rear portion 46 which is open to the top of the rim portion through a restricted slot 49 as shown in FIG. 3. Lateral slot 48 is formed in the handle molding 38 between the rear portion 46 and handle portion 52. A circular recess 50 is formed in the back edge of the slot 48. A handle opening 54 is provided in the handle portion 52 for convenient placement of the hand of the person who is using the vessel.

Figure 4:
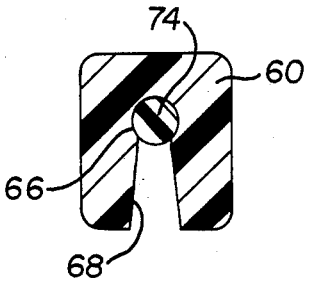
FIG. 4 is partial sectional view taken along lines 4—4 of FIG. 1.

The annular sleeve 56 is conical in shape and opens upwardly and outwardly with a spout portion 58 at a front portion. The sleeve 56 further slopes downwardly to a lower back portion 60. As illustrated in FIGS. 1 and 2, the outer surface of the annular sleeve 56 has a surface configuration complementary to the inner surface of the sloping rim portion 42. A central divider wall 69 extends diametrically across the annular sleeve 56 from the front spout 58 to the back portion 60. A lip 62 forming a hook is provided at a lower front portion of the sleeve 56 and a lateral bore 64 extends through the front portion of the sleeve 56. The lip 62 extends beneath the front inside edge of the handle molding 38 to retain the front of the annular sleeve 56 within the handle molding 38. The annular sleeve 56 also has a lateral bore 66 at a rear portion thereof and a restricted slot 68 as shown more clearly in FIG. 4. A circular sealing lip 70 is formed in the inside core surface of the annular sleeve 56 and forms semi-circular valve seats. Preferably, the annular sleeve 56 is injection molded from a relatively pliable ABS plastic material to form pliant valve seats.

The flapper valve assembly 72 has an elongated shaft 74 which supports semicircular valve elements 76 and 78 and a valve actuator 80 for rotational movement therewith. The shaft 74 extends at a forward portion into the lateral bore 64 in the front of the annular sleeve, through the lateral bore 66 in the rear of the annular sleeve, and through the bore 47 in the handle molding 38. The rear portion 46 of the shaft 74 extends through the slot 48 and into the circular recess 50 of the handle portion 52. The valve actuator 80 is positioned within the slot 48 and is free to rotate therein to rotate shaft 74 and thereby rotate in unison the valve elements 76 and 78. The included angle between the valve elements 76 and 78 is about 60° although this angle can vary over a relatively wide range.

The flapper valve assembly 72 is preferably injection molded in one piece from a relatively rigid plastic material such as Nylon or ABS which are FDA approved.

The dual server vessel is assembled by first molding the various parts, and adhesively securing together the lower section 16, the upper section 28 and the handle molding 38, all either by solvent welding or by suitable adhesives. Next, the flapper valve assembly 72 is mounted to the annular sleeve 56 by inserting the front end of the shaft 74 into the bore 64 and the rear portion of the shaft 74 into the lateral bore 66 through the restricted slot 68. Then, the flapper valve assembly 72 and the annular sleeve 56 are positioned onto the handle molding 38 by first positioning the lower lip 62 beneath the front portion of the molding 38 and dropping the rear portion thereof downwardly until the shaft 74 is received within the circular bore 47 and retained therein by the snap-fit relationship of the restricted slot 49. Further, the rear portion of the shaft 74 seats within the circular recess 50 in the slot 48.

As thus assembled, the user can grip the vessel by the handle portion 52 with fingers of the user extending through the handle opening 54. The thumb of the user can conveniently rest against the valve actuator 80 to move the valve actuator rotationally from the position illustrated in FIG. 3 to a rotational position approximately 60° counterclockwise as viewed in FIG. 3. In the first position, that is, the position illustrated in FIG. 3, the valve element 76 will be positioned securely against the central divider 34 whereas the valve element 78 will be positioned in a sealing relationship with one of the valve seats of the sealing lip 70 of the annular sleeve 56. The soft pliable nature of the sleeve 56 will provide a good seal between the valve element 78 and the sleeve 56. When the vessel is tilted, for example in a counterclockwise direction as viewed in FIG. 1, liquid positioned in the right side of the vessel as viewed in FIG. 2, will flow out through the opening between the valve element 76 and the annular sleeve 56 and can be poured from the spout formed by the front spout portion 58 of the annular sleeve 56. At the same time, liquid in the left side of the vessel (as viewed in FIG. 2) will flow up to the valve element 78 and be retained within the left side compartment.

When the valve actuator 80 is moved 60° in counterclockwise direction from the position shown in FIG. 2, the valve element 76 will move counterclockwise as viewed in FIG. 2 about shaft 74 into a sealing relationship with the other valve seat of the sealing lip 70 of the annular sleeve 56. At the same time, the valve element 78 will rotate counterclockwise about the axis of shaft 74 into engagement with the central divider 34. When the valve assembly is in the second position and the vessel is tipped to a pouring arrangement as described above, the liquid in the right side of the vessel (as viewed in FIG. 2) will be retained therein by the valve element 76 and the liquid in the left side of the vessel (as viewed in FIG. 2) will pass out through the opening between the valve element 78 and the annular sleeve 56 to thus be poured out of the spout formed by the front spout 58 of the annular sleeve 56.

The filling of the vessel is easily accomplished by rotating the valve either to the first position or the second position. The slanted opening of the annular sleeve provides a spout to fill the vessel. The central divider wall 69 in the annular sleeve keeps the liquid from flowing from one side to the other during pouring and during filling.

The positioning of the valve elements is important for the function of the dispenser. First, the height of dispenser can be less with the valve elements 76 and 78 adapted to rotate within the base. Secondly, the seating of the valve elements against the inner or lower portion of the seat 70 provides a positive stop for the valve elements and aids in the sealing process. The weight of the liquid tends to enhance the sealing rather than to unseat the seal during the pouring process.

Cleaning of the vessel is facilitated by removing the annular sleeve and flapper valve assemblies, a process reversed from that described above. Because of the snap-fit relationship between the parts, the flapper valve assembly 72 and the annular sleeve 56 can easily be removed as a unit for cleaning. If desirable, the flapper valve assembly 72 and the annular sleeve 56 can also be separated from each other for cleaning purposes.

The invention provides a vessel for pouring two types of liquids, for example caffeine-containing and caffeine-free coffee. The vessel eliminates the need for two separate vessels to pour two separate types of coffees. Thus, a waitress or waiter can have one hand free while pouring either type of coffee. The invention is particularly suitable for use in connection with serving two types of coffees but can be used for other types of diverse liquids as well.

The invention can be manufactured simply and easily from molded plastic material. Yet, it is safe to use and can withstand heat at the bottom, which is conventional in coffee-making machines. Further, the vessel is more durable than conventional glass pots.

Whereas the invention has been disclosed as including a plastic molded base portion 12. However, it is within the scope of the invention to make the base 12 partially or wholly out of glass or any suitable metal such as stainless steel or aluminum.

Reasonable variation and modification are possible within the scope of the foregoing disclosure and drawings without departing from the spirit of the invention.

The embodiments of the invention in which an exclusive property or privilege is claimed are defined as follows:

1. A hand-held, portable liquid dispenser for selectively dispensing one of two different liquids from a single container, said dispenser comprising:

a base forming first and second separate horizontally disposed compartments separated by a liquid-impermeable barrier;

a neck secured to said base, mounting a handle at one side and forming a spout on an opposite side thereof, said neck having a central opening through which liquid may be introduced into the base and dispensed from the base;

valve means mounted in said neck and having a sleeve forming valve seats at a bottom portion thereof and first and second valve elements rotatable in unison in said neck between first and second positions, said first valve element is in seating contact with one of said seats, blocking communication between said first compartment and said spout, when in said first position and is adjacent said barrier, opening communication between said first compartment and said spout, when in said second position, said second valve element is adjacent said barrier, opening communication between said second compartment and said spout when in said first position and is in sealing contact with the other of said seats, blocking communication between said second compartment and said spount, when in said second position;

said liquid-impermeable barrier comprising a wall which extends up to said valve seats; and actuator means coupled to said valve means for moving said valve elements between said first and second positions and mounted on said neck in close proximity to said handle so that said actuator means can be operated by the thumb of a user whose hand grips the dispenser by the handle.

2. A liquid dispenser according to claim 1 wherein said valve means sleeve is circular; and said valve elements are semicircular in shape.

3. A liquid dispenser according to claim 2 wherein said valve elements have an included angle of about 60° therebetween.

4. A liquid dispenser according to claim 2 and further comprising means for rotatably mounting said valve elements in said sleeve.

5. A liquid dispenser according to claim 4 wherein said sleeve is mounted in snap-fit engagement in said neck.

6. A liquid dispenser according to claim 5 wherein said valve elements and actuator are mounted in snap-fit engagement in said sleeve.

7. A liquid dispenser according to claim 6 wherein said sleeve is formed of a relatively soft material to form pliant seats.

8. A liquid dispenser according to claim 7 wherein said neck is permanently secured to an upper portion of said base.

9. A liquid dispenser according to claim 8 wherein said base is at least partially molded from a plastic material with said liquid-impermeable barrier.

10. A liquid dispenser according to claim 9 wherein said base further comprises a metal bottom plate integrally molded to said molded plastic material.

11. A liquid dispenser according to claim 2 wherein said sleeve is mounted in snap-fit engagement in said neck.

12. A liquid dispenser according to claim 11 wherein said valve elements and said actuator are mounted in snap-fit engagement in said sleeve.

13. A liquid dispenser according to claim 1 wherein said base is at least partially molded from a plastic material with said liquid-impermeable barrier.

14. A liquid dispenser according to claim 13 wherein said base further comprises a metal bottom plate integrally molded to said molded plastic material.

15. In a liquid dispenser having an open-top base for holding liquid and an annular neck secured to said base, said neck forming a spout on one side and a handle on another side thereof, the neck having a central opening through which liquid may be introduced into the base and dispensed from the base;

the improvement which comprises:

a liquid-impermeable barrier dividing said base into two separate horizontally disposed compartments;

valve means mounted in said neck and comprising valve seats disposed in said central opening and valve elements mounted in abutting relationship with said barrier and adapted to alternately seat against said valve seats to close off one of said two compartments, while opening the other, and vice versa, said valve means further comprising means to rotatably mount said valve elements in said neck for rotational movement to swing downwardly into said base between said seats and said barrier; and actuator means coupled to said valve elements to rotate said valve elements between said two alternate positions.

16. A liquid dispenser according to claim 15 wherein said barrier extends to said valve seats and forms a pair of semicircular openings therewith; and said valve elements have a semicircular shape to conform with said semicircular openings.

17. A liquid dispenser according to claim 16 wherein the included angle between said valve elements is about 60°.

18. A liquid dispenser according to claim 16 wherein said valve seat is formed in an annular sleeve of a relatively soft material.

19. A liquid dispenser according to claim 18 wherein said valve elements are snap-fit into said annular sleeve.

20. A liquid dispenser according to claim 19 wherein said annular sleeve is snap-fit into said neck.

21. A liquid dispenser according to claim 20 wherein said actuator is mounted in close proximity to said handle so that one can operate said actuator with the thumb of a hand which grips said handle.

22. A liquid dispenser according to claim 16 wherein said base is at least partially molded from a plastic material and has a metal bottom plate integrally molded therewith.

23. A hand-held, portable liquid dispenser for selectively dispensing one of two different liquids from a single container, said dispenser comprising:

a base forming first and second separate horizontally disposed compartments separated by a liquid-impermeable barrier, said base having a metal bottom portion and a molded plastic upper portion forming said barrier, said metal base being integrally molded to said plastic upper portion;

a neck secured to said base, mounting a handle at one side and forming a spout on an opposite side thereof, said neck having a central opening through which liquid may be introduced into the base and dispensed from the base;

valve means mounted in said neck and having first and second valve elements rotatable in unison in said neck between first and second positions, said first valve element blocking communication between said first compartment and said spout when in said first position and opening communication between said first compartment and said spout when in said second position, said second valve element opening communication between said second compartment and said spout when in said first position and blocking communication between second compartment and said spout when in said second position; and actuator means coupled to said valve means for moving said valve elements between said first and second positions and mounted on said neck in close proximity to said handle so that said actuator means can be operated by the thumb of a user whose hand grips the dispenser by the handle.

24. A liquid dispenser according to claim 23 wherein said barrier extends to and is in sealing engagement with said metal bottom portion and extends upwardly therefrom to and in sealing engagement with said valve means.

* * * * *